United States Patent [19]

Donomoto et al.

[11] Patent Number: 4,576,863

[45] Date of Patent: Mar. 18, 1986

[54] COMPOSITE MATERIAL AND PROCESS FOR ITS PRODUCTION

[75] Inventors: Tadashi Donomoto; Mototsugu Koyama; Yoshio Fuwa; Nobuhiro Miura, all of Toyota; Tatsuo Sakakibara, Ueda, all of Japan

[73] Assignees: Toyota Jidosha Kabushiki Kaisha, Toyota; Art Kinzoku Kogyo Kabushiki Kaisha, Tokyo, both of Japan

[21] Appl. No.: 515,050

[22] PCT Filed: Dec. 18, 1981

[86] PCT No.: PCT/JP81/00399

§ 371 Date: Jul. 15, 1983

§ 102(e) Date: Jul. 15, 1983

[87] PCT Pub. No.: WO83/01960

PCT Pub. Date: Jun. 9, 1983

[30] Foreign Application Priority Data

Nov. 30, 1981 [JP] Japan ..... 56-191919

[51] Int. Cl.[4] ..... B32B 5/16; B32B 15/04

[52] U.S. Cl. ..... 428/325; 428/283; 428/285; 428/392; 428/433

[58] Field of Search ..... 428/283, 285, 433, 432, 428/325, 392

[56] References Cited

FOREIGN PATENT DOCUMENTS 2853724 6/1980 Fed. Rep. of Germany ..... 428/283

15308 3/1983 Japan ..... 428/285

*Primary Examiner*—Paul J. Thibodeau

*Attorney, Agent, or Firm*—Oblon, Fisher, Spivak, McClelland & Maier

[57] ABSTRACT

A light metal composite material reinforced by alumina-silica fibers and a method for producing same. The composite material can have high mechanical qualities such as high workability and high wear resistance as well as high thermal qualities such as high fatigue resistance and high thermal conductivity and can also have high mating performance not to cause much wear of the mating member when the assemblage of alumina-silica fibers incorporated in the composite material as reinforcing members includes not more than 17 wt. % non-fibered particles, particularly not more than 7 wt. % of non-fibered particles of not smaller than 150 microns diameter, and has a virtual density of 0.08–0.3 g/cm$^3$. The efficiency of production of the composite material is improved by binding the alumina-silica fibers provisionally with one another by an inorganic binder to have a compression strength no lower than 0.2 kg/cm$^2$.

4 Claims, 20 Drawing Figures

(x 200)

(x200)

(x3)

(x100)

(x200)

(x100)

(x100)

COMPOSITE MATERIAL AND PROCESS FOR ITS PRODUCTION

BACKGROUND OF THE INVENTION

1. Field of the Invention

The present invention relates to a composite material and a process for its production, and more particularly, relates to a fiber reinforced light alloy composite material including alumina-silica fibers as its reinforcing material and a method for producing such a composite material.

2. Description of the Prior Art

In automobiles and aircrafts, in order to save energy by lowering fuel consumption and to increase their operational speed, there have been made various attempts to lighten the structural members of them. As a measure for lightening their structural members, it has been considered to construct them by light alloy materials such as aluminum alloys and magnesium alloys. However, when the structural members of automobiles or aircrafts are made of only such light alloy materials, it is very difficult to ensure such high strength, anti-wearing characteristic, and anti-seizing characteristic of their structures that would sufficiently guarantee their their valid operation. Therefore, it has been attempted to construct these structural members by composite materials of the kind which has a matrix made of aluminum, magnesium or their alloys and is reinforced by fibers such as alumina-silica fibers, crystallized glass fibers, stainless steel fibers, etc., which are incorporated in the matrix.

However, since inorganic fibers as mentioned above are generally much harder than aluminum, magnesium or their alloys forming the matrix, the composite materials which include such hard reinforcing fibers are bound with difficult problems that they can not be readily worked by lathing or the like, and that they cause severe wearing of mating members which are moved relative to and in contact with them. Ironically, these problems are especially serious with respect to the composite materials which include alumina-silica fibers as the reinforcing materials which are highly compatible with aluminum, magnesium or their alloys and which have high thermal resistance. A bundle of alumina-silica fibers include generally about 50 wt.% non-fibered particles, which are called "shot", of various sizes. The diameters of these particles are generally much larger than those of the fibers, and, since the particles are very hard, it is very difficult to work these composite materials which include the alumina-silica fibers as well as these particles, and they cause abnormal wearing of their mating members.

In view of the problems encountered in the prior art with regard to the conventional composite materials having a matrix of aluminum, magnesium or their alloys and reinforcing fibers of inorganic materials, the present inventors had made various composite materials having a matrix of aluminum, magnesium or their alloys and reinforcing means of alumina-silica fibers and after extensive experimental research, have found that the above-mentioned problems could be solved if the virtual density of the non-fibered particles included in the bundle of alumina-silica fibers should be limited within a certain range. Further, the present inventors have also found that, in order to efficiently produce a composite material which has a matrix of aluminum, magnesium or their alloys and is reinforced by a bundle of alumina-silica fibers, the compression strength of the bundle of alumina-silica fibers must be controlled within a range, and that, in order to obtain such certain required compression strength of the bundle of alumina-silica fibers, the amount of inorganic binder must also be controlled within a certain range.

SUMMARY OF THE INVENTION

This invention provides a composite material having a matrix of aluminum, magnesium or their alloys and reinforcing fibers of alumina-silica fibers which is superior in its mechanical characteristics such as strength and wear resistance as well as in its thermal characteristics such as thermal fatigue durability and thermal conductivity, and is improved with respect to its workability and wear causing characteristic against mating members.

The present invention provides a method for efficiently producing such a composite material as mentioned above.

DESCRIPTION OF THE PRESENT INVENTION

According to the present invention a composite material is provided comprising a matrix of a metal selected from a group consisting of aluminum, magnesium and their alloys, and reinforcing members of an assemblage of alumina-silica fibers containing not less than 40 wt.% alumina, said assemblage of alumina-silica fibers having a virtual density of 0.08–0.3 g/cm$^3$ and including not more than 17 wt.% non-fibered particles, particularly not more 7 wt.% non-fibered particles of not smaller than 150 microns diameter, and by a method for producing a composite material comprising the steps of preparing an assemblage of alumina-silica fibers containing not less than 40 wt.% alumina, said assemblage having a virtual density of 0.08–0.3 g/cm$^3$ and including not more than 17 wt.% non-fibered particles, particularly not more than 7 wt.% non-fibered particles of not smaller than 150 microns diameter; binding said alumina-silica fibers with one another by an inorganic binder so that said assemblage of alumina-silica fibers has a compression strength not lower than 0.2 kg/cm$^2$; placing said assemblage of alumina-silica fibers thus treated in a casting mold; pouring a metal selected from a group consisting of aluminum, magnesium and their alloys in a molten state into said casting mold; and applying pressure to the molten metal in said casting mold while the molten metal is cooled down and solidified in said casting mold.

The composite material of this invention which was produced by the method of this invention as mentioned above has a structure that the matrix of aluminum, magnesium or their alloys is reinforced by the assemblage of highly anti-wearing alumina-silica fibers, and therefore has high anti-wearing characteristics on the one hand, while on the other hand, by the amount of the very hard non-fibered particles included in the alumina-silica fibers being limited not to be more than 17 wt.%, particularly not to be more than 7 wt.% with respect to such particles that have diameters not less than 150 microns, the composite material shows high workability when compared with conventional composite materials of the same kind. Further, by the virtual density of the assemblage of alumina-silica fibers being limited to be 0.08–0.3 g/cm$^3$, the composite material according to the present invention does not cause any cracking in the interface between the composite material and another non-composite material when they are combined to provide a structural member and are subjected to heating and cooling cycles, and further has high heat conductivity of substantially the same order as the matrix metal, in spite of its high wear resisting characteristic.

Further, according to the present method, the composite material having high mechanical and thermal characteristics can be produced with high productivity, without causing any undesirable deformation of the assemblage of alumina-silica fibers due to compression.

The alumina-silica fibers are generally classified into glass fibers, silica-alumina fibers and alumina fibers. In these fibers, the glass fibers containing less than 40 wt.% alumina has low thermal resistance, and are deteriorated in the process of forming a composite material by reacting with molten aluminum, magnesium or their alloys, and therefore are not desirable as the reinforcing members of the composite material. By contrast, the so-called silica-alumina fibers containing not less than 40 wt.% alumina have high thermal resistance and are less liable to deterioration in the process of forming the composite material. Therefore, the alumina-silica fibers to be employed in the present invention are specified to be alumina-silica fibers containing not less than 40 wt.% alumina, i.e. silica containing alumina fibers or silica-alumina fibers, or alumina fibers.

However, in the assemblage of these fibers there are included a relatively large amount of non-fibered particles, although the amount of these particles differs according to the process for producing the fibers. These non-fibered particles have high hardness such as Hv=500 or more. Further, the diameters of these particles are very large such as to be tens to several hundred microns in contrast to the diameters of the fibers which are in the range of several microns. Therefore, these non-fibered particles included in the assemblage of fibers lower the workability of the composite material and would cause such troubles that a mating member moved relatively to and in contact with a member made of the composite material is seriously worn and that the non-fibered particles are dropped off from the matrix and cause troubles in the mating member such as scuffing. In order to solve these problems, the amount of the non-fibered particles included in the assembly of alumina-silica fibers must be suppressed to be not more than 17 wt.%, preferably not more than 10 wt.%, and particularly the amount of the non-fibered particles having diameters not less than 150 microns should be suppressed to be not more than 7 wt.%, more preferably not more than 2 wt.%.

Further, in order to produce a composite material having high quality with respect to wear resistance, by making the most use of the above-mentioned assemblage of alumina-silica fibers having the desirable characteristics, it is also required that the virtual density of the assemblage of the fibers should be not lower than 0.08 g/cm$^3$. However, when the virtual density becomes higher than 0.3 g/cm$^3$, the wearing of a mating member abruptly increases, and further there occurs a problem that, when such a composite material is used as combined with another material so as to form a local portion of a mechanical element which is subjected to heating and cooling cycles, cracks are generated between the composite material and said another material due to the difference between the thermal expansion coefficient of the matrix material and that of the reinforcing fibers. Therefore, the virtual density of the assemblage of fibers needs to be limited not to be higher than 0.3 g/cm$^3$, preferably not to be higher than 0.25 g/cm$^3$.

As a method for embedding the assemblage of alumina-silica fibers in the matrix of aluminum, magnesium or their alloys as reinforcing members, the high pressure casting or the molten metal forging is advantageously employable, because these methods can produce a composite material with reinforcing fibers uniformly distributed in the matrix, and further because according to these methods it is possible to produce a composite material portion only at a limited part of an article if required. In these methods a molten metal for the matrix is pressurized up to a high pressure such as 200–1000 kg/cm$^2$ so that the molten metal should infiltrate into spaces formed among the fibers of the assemblage of fibers, and therefore the assemblage of fibers must have a high strength to endure such a high pressure applied by the molten metal to form the matrix. Otherwise the assemblage of fibers will be deformed by compression and the fibers will not be uniformly distributed in a predetermined part of the matrix at a predetermined density. Therefore, in order to endure the pressure applied by the molten matrix metal the assemblage of fibers needs to have a compression strength not lower than 0.2 kg/cm$^2$, preferably not lower than 0.5 kg/cm$^2$.

In order to increase the compression strength of the assemblage of the fibers it will be contemplated to increase the diameters of the individual fibers. However, when the diameters of the individual fibers are increased, the uniformity of the distribution of the fibers in the matrix lowers, and further it becomes difficult to form the fibers into a required shape. This problem is solved by binding the individual fibers by an inorganic binder which does not lose its binding performance even when it has been exposed to the molten matrix metal at a relatively high temperature. By such binding of the fibers the compression strength of the assemblage of the fibers is desirably increased. The inorganic binders for this purpose may be colloidal silica, colloidal alumina, water glass, cement, and alumina phosphate solution, which solidify when dried. These inorganic binders may be applied to the reinforcing fibers according to such processes that the fibers are dispersed in the solution of the binder, the solution is agitated with the fibers dispersed therein, the fibers are gathered in the solution by the method of vacuum forming or the like, and the gathered fibers are dried and burned.

In this connection, since the silica used as the inorganic binder reacts, as different from the silica included in alumina-silica fibers, with, aluminum, magnesium or their alloys used as the matrix metal and affects adversely to the quality of the composite material, the content of the silica as the inorganic binder or as a component of the inorganic binder included in the assemblage of the fibers should be limited to be less than 20 wt.%, preferably less than 15 wt.%.

Although it is desirable that all the fibers in the assemblage of the fibers should be oriented three dimensionally at random, no method intensionally to accomplish such a condition has not yet been developed. Currently the reinforcing fibers are generally oriented at random in the x-y plane of an x-y-z rectangular coordinate system and such a layer is piled up in the direction of the z axis. A composite material incorporating such an orientation arrangement of the reinforcing fibers shows a little better wear resistance in its faces along the x-z plane and the y-z plane than in its face along the x-y plane. However, with respect to the other mechanical and thermal characteristics, no substantial difference exists between the directions x, y and x. Therefore, with respect to the composite material and the method for producing same according to the present invention it is desirable that the orientation of the reinforcing fibers should be so designed that the face which needs to be superior in wear resistance should extend along the y-z plane or the x-z plane.

In the following, the present invention will be described in detail with respect to some preferred embodiments thereof with reference to the accompanying drawings.

BEST MODE FOR CARRYING OUT THE INVENTION

Embodiment 1

Composite materials have been made by using various reinforcing fibers as shown in Table 1. In Table 1, $A_1$–$A_5$ are silica-alumina fibers produced by Isolite-Babcock Refractories Company and having trademark "KAOWOOL"; $B_1$ and $B_2$ are alumina fibers produced by Denki Kagaku Kogyo Company and having trademark "ARSEN"; and C is alumina fibers produced by ICI Company and having trademark "SAFIL".

TABLE 1

| Particulars | Reinforcing Fibers | | | | | | | |
|---|---|---|---|---|---|---|---|---|
| | $A_1$ | $A_2$ | $A_3$ | $A_4$ | $A_5$ | $B_1$ | $B_2$ | C |
| Total amount of non-fibered particles (wt. %) | 22 | 17.0 | 9.8 | 6.3 | 2.5 | 20 | 1.0 | 1.0 |
| Amount of non-fibered particles of not smaller than 150 microns diameter (wt. %) | 14 | 7.0 | 1.8 | 0.5 | 0.2 | 7.5 | 0.1 | 0.1 |
| Content of alumina (wt. %) | | | 47.3 | | | | 80.2 | 94.8 |
| Content of silica (wt. %) | | | 52.6 | | | | 19.8 | 5.2 |
| Virtual density of assemblage of fibers (g/cm$^3$) | | | 0.16 | | | | 0.15 | 0.15 |
| Mean diameter of fibers (microns) | | | 2.8 | | | | 2.9 | 3.4 |
| Content of alpha alumina (wt. %) | | | — | | | | — | 65 |

Figure 1:
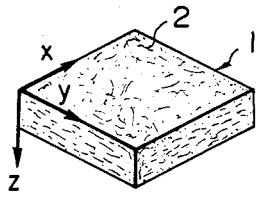
FIG. 1 is a schematic view showing the orientation of the fibers in an assemblage of fibers.
Figure 3:
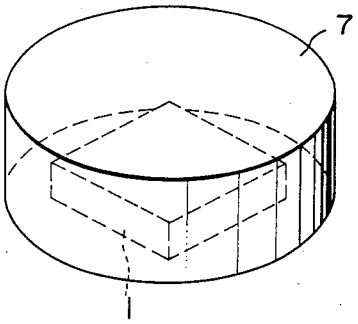
FIG. 3 is a schematic perspective view showing a block, a part of which is formed as a composite material reinforced by an assemblage of fibers.
Figure 2:
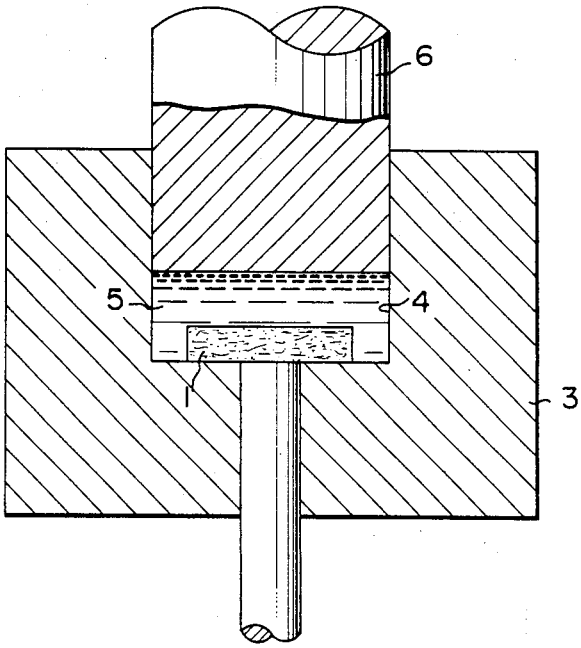
FIG. 2 is a schematic view showing a casting process in the method for producing a composite material according to the present invention.

These reinforcing fibers were first soaked in colloidal silica, and were uniformly dispersed therein by agitation. Then the fibers were gathered by a vacuum forming method to form an assemblage of fibers 1 as shown in FIG. 1, having dimensions of 80×80×20 mm. The block was burnt at 600° C., whereby the reinforcing fibers 2 were bound together by silica. In this case, as shown in FIG. 1, the reinforcing fibers 2 are oriented at random in x-y planes and such imaginary thin layers are piled up in the direction of z. The assemblage of fibers 1 thus obtained was placed in a mold cavity 4 of a casting mold 3, and then molten metal 5 of an aluminum alloy (JIS AC8A) was poured into the mold cavity. Then by a plunger 6 engaged into a corresponding bore formed in the casting mold 3 a pressure of 1000 kg/cm$^2$ was applied to the molten metal. The pressure was maintained until the molten metal 5 had completely solidified. Thus a cylindrical block having a diameter of 110 mm and a height of 50 mm was obtained. By applying heat treatment $T_7$ to this block, a block 7 having a part formed as a composite material reinforced by fibers as shown in FIG. 3 was obtained.

From this block 7 test pieces for wearing tests, rotational bending fatigue tests, and thermal conductivity tests were produced by mechanical cutting.

Figure 4:
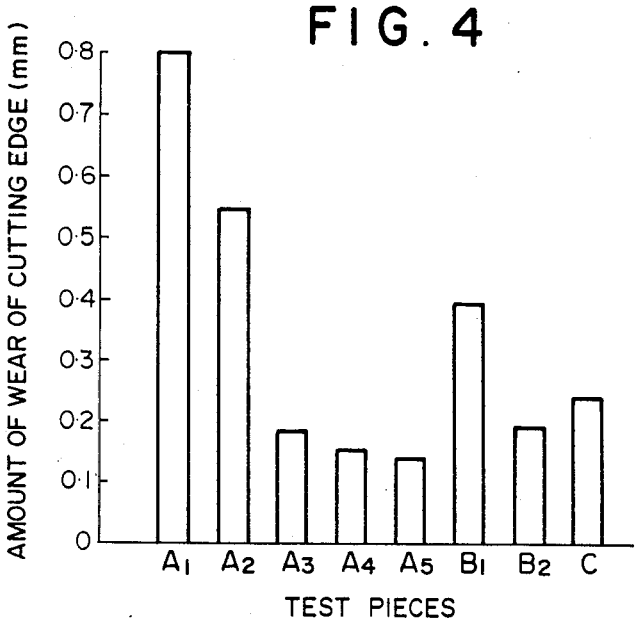
FIG. 4 is a graph showing the wearing amount of cutting tools after cutting of a predetermined amount of several kinds of composite materials.

This mechanical cutting was done by using a cutting tool of sintered carbide at a cutting speed of 150 m/min and at a feeding of 0.03 mm/revolution under the supply of water as coolant. The amount of wearing of the cutting tool for a predetermined amount of cutting was measured. The results are shown in FIG. 4. As seen in FIG. 4, the composite materials reinforced by fibers $A_1$ and $B_1$ which include a relatively large amount of non-fibered particles, and which include relatively large non-fibered particles such as having diameters of not smaller than 150 microns, show low workability for cutting as compared with the other composite materials. From these results it will be understood that in order to obtain a composite material having desirable workability for cutting the content of the non-fibered particles needs to be not more than 17 wt.%, preferably not more than 10 wt.%, and that the content of large non-fibered particles such as having diameters not smaller than 150 microns needs to be not more than 7 wt.% preferably not more than 2 wt.%.

Figure 5:
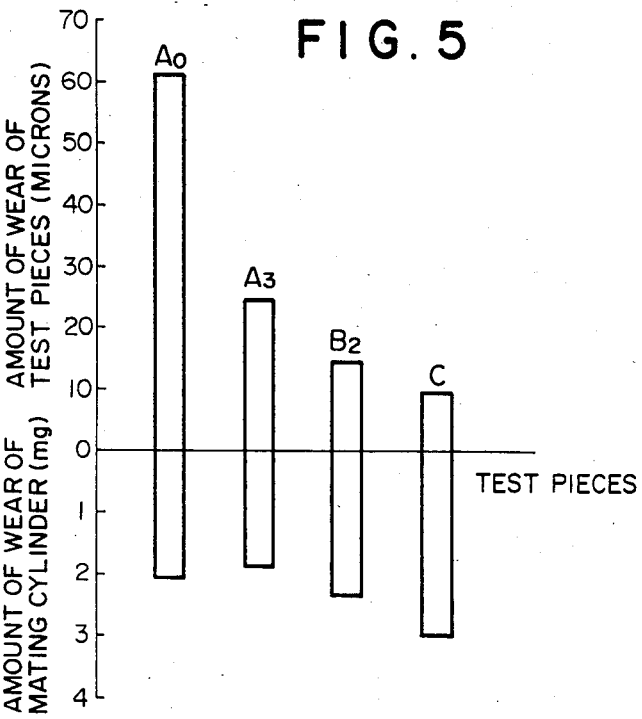
FIG. 5 is a graph showing the wearing amount of test pieces made of several composite materials and the wearing amount of mating members.

Wearing test pieces of the composite materials reinforced by fibers $A_3$, $B_2$ and C, respectively, were tested in a wear test machine about their wear resistance in such a manner that each test piece was pressed against the outer peripheral surface of a cylindrical mating member made of a nodular graphite cast iron (JIS FCD70) and the cylindrical mating member was turned at a speed which provides a relative speed between the test piece and the outer peripheral surface of the mating cylindrical member of 0.3 m/sec under a contacting pressure of 20 kg/mm$^2$ while a lubricating oil (Castle Motor Oil 5W-30) at room temperature (20° C.) was being supplied to the contacting surfaces. This test was carried on for one hour. For the purpose of comparison, a wear test piece ($A_0$) made of only the same aluminum alloy (JIS AC8A) and treated with thermal treatment $T_7$ was tested in the same manner. The results of these wearing tests are shown in FIG. 5. In FIG. 5, the upper half portions show the wear amounts (depth of wear scars in microns) of the test pieces, while lower half portions show the wear amounts (weight reduction by wear in mg) of the cylindrical mating member.

From FIG. 5, it will be understood that the composite materials reinforce by alumina-silica fibers are subject to less wearing than the aluminum alloy having no reinforcing fibers. Further, it will be understood that the wear resistance of the composite materials increases as the content of alumina increases, and that the wear amount of the mating member also increases as the content of alumina increases.

Figure 6:
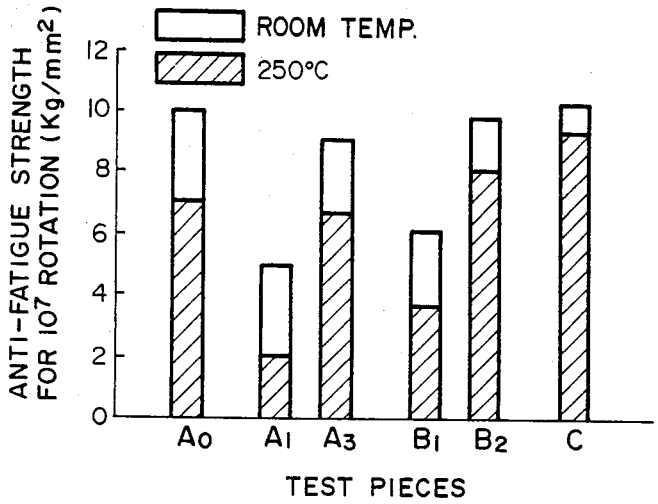
FIG. 6 is a graph showing the bending fatigue strength of several composite materials after $10^7$ times rotational bending at room temperature and at 250° C.

Test pieces of the composite materials reinforced by fibers $A_1$, $A_3$, $B_1$, $B_2$ and C and a test piece ($A_0$) of the same aluminum alloy (JIS AC8A) having no reinforcing fibers and treated by heat treatment $T_7$ were tested with respect to their rotational bending fatigue characteristics in such a manner that each test piece was rotated around its axis under the application of a load at right angle to the axis of rotation and the relation between the load which caused breakage of the test piece and the number of rotation was obtained. FIG. 6 shows the test results, in which the values of fatigue strength which endure $10^7$ rotations at room temperature (20° C.) and at 250° C. are shown.

From this figure, it will be understood that the composite materials reinforced by fibers $A_1$ and $B_1$ have much lower fatigue strength at room temperature as well as at 250° C. as compared with the other composite materials.

Thermal conductivity test pieces were prepared with respect to the composite materials reinforced by fibers $A_3$, $B_2$ and C. For the purpose of comparison a test piece ($A_0$) of the same aluminum alloy (JIS AC8A) having no reinforcing fibers and treated by heat treatment $T_7$ and a test piece (N) of niresist cast iron were prepared. These test pieces were tested of their thermal conductivity. The results are shown in FIG. 7.

Figure 7:
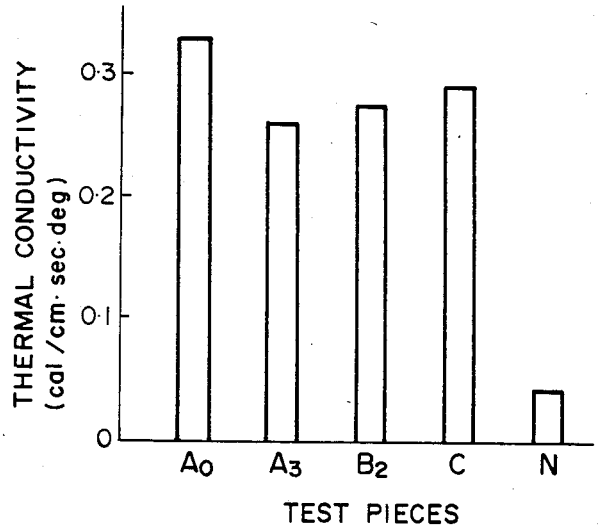
FIG. 7 is a graph showing the thermal conductivity of several composite materials and some other materials.

From FIG. 7 it will be understood that the composite materials reinforced by the reinforcing fibers show the values of thermal conductivity slightly lower than that of the aluminum alloy having no reinforcing fibers, but their thermal conductivity is much superior to that of cast iron. Further, it will be understood that the composite materials have higher thermal conductivity as the reinforcing fibers have a higher content of alumina.

Embodiment 2

By using alumina fibers having a mean fiber diameter of 3.4 microns and having a composition of 94.8 wt.% $Al_2O_3$ and 5.2wt.% $SiO_2$ and by varying the content of silica as an inorganic binder, several assemblages of fibers having a virtual density of 0.15 g/cm$^3$ and having various values of compression strength as shown in Table 2 were prepared. In Table 2 the compression strength of the assemblage of fibers in the compression strength in the direction of x or y in FIG. 1.

TABLE 2

| | Assemblage of alumina fibers | | | | | | |
|---|---|---|---|---|---|---|---|
| | $C_1$ | $C_2$ | $C_3$ | $C_4$ | $C_5$ | $C_6$ | $C_7$ |
| Content of silica (wt. %) | 30 | 20 | 15 | 10 | 7 | 5 | 3 |
| Compression strength (kg/cm$^2$) | 4.5 | 3.7 | 3.1 | 1.9 | 0.6 | 0.2 | 0.1 |

Figure 8:
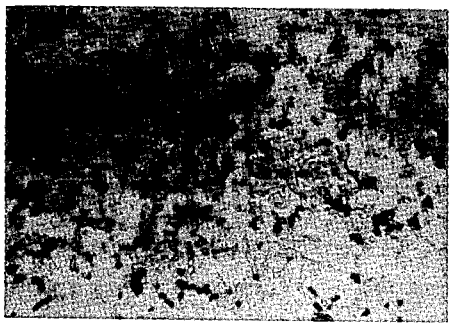
FIG. 8 is a microscopic photograph showing a normal structure of a composite material having no void by 200 magnification.
Figure 9:
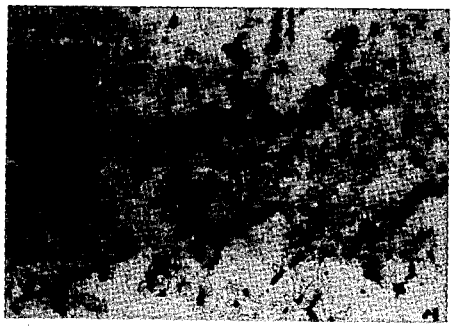
FIG. 9 is a microscopic photograph showing an abnormal structure of a composite material including voids generated in its structure by 200 magnification.

By using these assemblages of fibers as the reinforcing members, composite materials were made in the same manner as in Embodiment 1. The composite materials thus obtained were broken and the deformation due to compression of the assemblage of fibers was measured. As the results it was found that the assemblages of fibers $C_1$–$C_4$ having compression strength higher than or equal to 1.9 kg/cm$^2$ were caused no deformation due to compression; the assemblage of fibers $C_5$ having compression strength of 0.6 kg/cm$^2$ was caused a deformation due to compression of smaller than 5%; the assemblage of fibers $C_6$ having compression strength of 0.2 kg/cm$^2$ was caused a deformation due to compression of less than 10%; and the assemblage of fibers $C_7$ having compression strength of 0.1 kg/cm$^2$ was caused a deformation due to compression of 20–50%. When the sectional surfaces of the composite materials were inspected by an optical microscope, the composite materials in which silica content is 15 wt.% or less showed a normal structure with no void as shown in FIG. 8, whereas the composite materials in which silica content is 20 wt.% or more showed an abnormal structure having voids as shown in FIG. 9.

Similar tests were done by using water glass and cement as the inorganic binder and similar results were obtained.

Embodiment 3

Silica-alumina fibers having a mean fiber diameter of 2.8 microns and a composition of 47.3 wt.% $Al_2O_3$, 52.6 wt.% $SiO_2$ were formed into several assemblages of fibers of a shape of 80×80×20 mm of various values of the virtual density as shown in Table 3. These assemblages of fibers included 6.3 wt.% non-fibered particles and 10 wt.% silica as an inorganic binder.

TABLE 3

| | Assemblage of alumina silica fibers | | | | | |
|---|---|---|---|---|---|---|
| | $A_{11}$ | $A_{12}$ | $A_{13}$ | $A_{14}$ | $A_{15}$ | $A_{16}$ |
| Virtual density (g/cm$^3$) | 0.34 | 0.29 | 0.23 | 0.13 | 0.08 | 0.05 |

Figure 10:
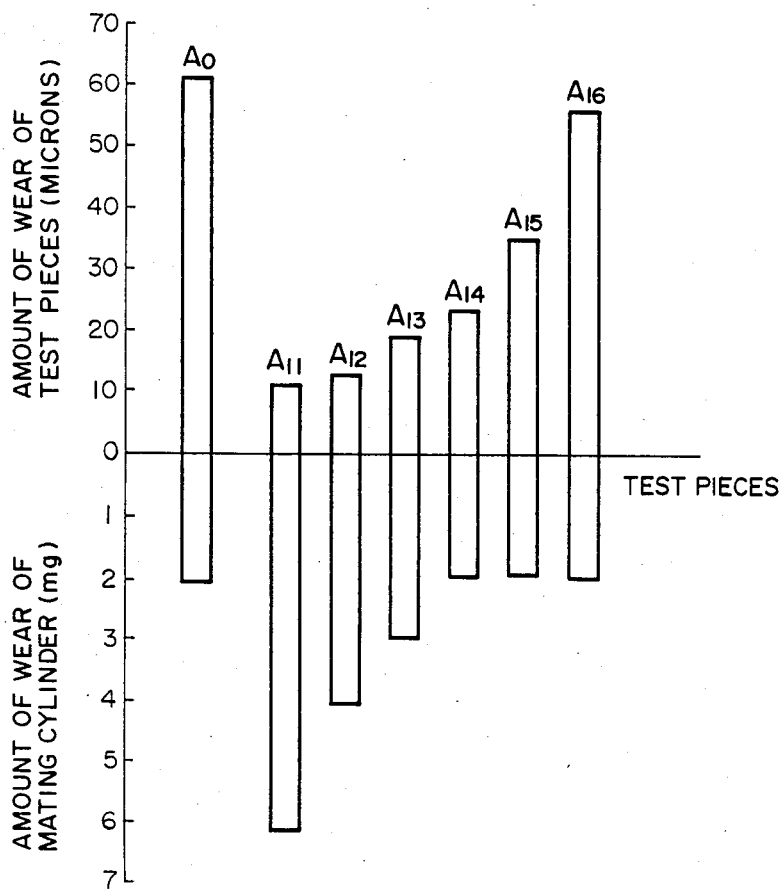
FIG. 10 is a graph similar to FIG. 5 showing the wearing amount of various composite materials having different values of the virtual density and the wearing amount of mating members.

By using these assemblages of fibers, in the same manner as in Embodiment 2, blocks having an outer diameter of 110 mm and a hight of 50 mm and incorporating each one of the assemblages of fibers were made and treated by heat treatments $T_7$. Test pieces were cut out from the fiber reinforced portions of these blocks, and by using these test pieces wearing tests were performed in the same manner as in Embodiment 1. For the purpose of comparison another test piece ($A_0$) was prepared from the same aluminum alloy including no reinforcing fibers and treated by heat treatment $T_7$, and this test piece was also tested. The results are shown in FIG. 10. In FIG. 10, the upper half portions show the amounts of wear (depth of wear scars in microns) of the test pieces, while the lower half portions show the amounts of wear (reduction of weight in mg) of the mating cylindrical member.

From FIG. 10, it will be understood that the wear resistance of the composite material in which the virtual density of the assemblage of fibers is 0.05 g/cm$^3$ is very low; the wear resistance of the composite material increases as the virtual density of the assemblage of fibers increases; when the virtual density of the assemblage of fibers is 0.34 g/cm$^3$ the amount of wear of the mating member is very large; the amount wear of of the mating member decreases as the virtual density of the assemblage of fibers decreases; and therefore the virtual density of the assemblage of silica-alumina fibers should desirably be 0.08–0.3 g/cm$^3$, more preferably 0.08–0.25 g/cm$^3$.

Figure 11:
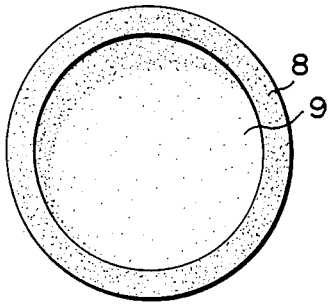
FIG. 11 is a schematic front view of a test piece used in a thermal fatigue test.

Assemblages of silica-alumina fibers were made to have a shape of 95 mm outer diameter×75 mm inner diameter×10 mm height and various values of the virtual density as shown in Table 3. By using these assemblages of fibers, in the same manner as in Embodiment 2, blocks having a diameter of 110 mm and a height of 50 mm were prepared and treated by heat treatment $T_7$. From these block disk-shaped test pieces such as shown in FIG. 11 including a composite portion 8 and a non-composite portion 9 and having a diameter of 92 mm and a thickness of 5 mm were cut out. These test pieces were tested about their thermal fatigue characteristics in such a manner that the test pieces were kept in a harness for 10 minutes at a temperature of 350° C., and then were cooled in water for 5 minutes, such heating and cooling cycles being repeated until a crack is generated in the test piece. The results are shown in FIG. 12.

Figure 12:
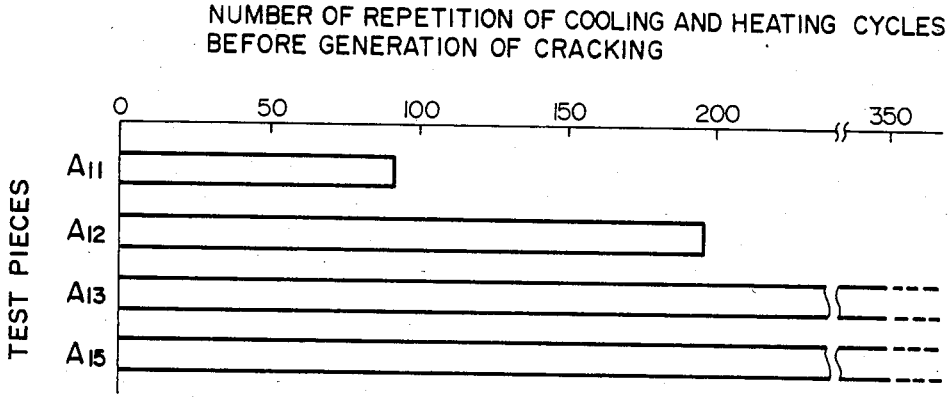
FIG. 12 is a graph showing the results of the thermal fatigue test.

As seen from FIG. 12, the composite material ($A_{11}$) in which the virtual density of the assemblage of fibers was 0.34 g/cm$^3$ was caused thermal fatigue cracking after a very small number of repetition of the heating and cooling cycles, while the composite materials ($A_{12}$, $A_{13}$, $A_{15}$) incorporating the assemblages of fibers having relatively low values of the virtual density were much improved in their thermal fatigue characteristics. The composite materials ($A_{13}$) and ($A_{15}$) were free from any thermal fatigue cracking after 350 times repetition of the heating and cooling cycles.

Figure 13:
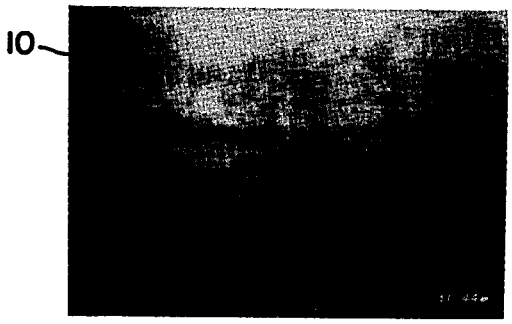
FIG. 13 is a photograph showing thermal fatigue cracks generated by the thermal fatigue test by 3 magnification.

FIG. 13 is a photograph showing thermal fatigue cracks 10 generated between the composite portion designated by 8 and the non-composite portion designated by 9 of the composite material ($A_{11}$) by 3 magnification.

Embodiment 4

Figure 14:
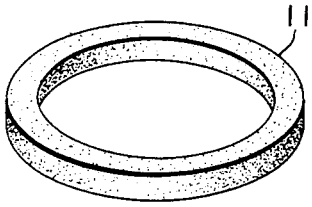
FIG. 14 is a schematic perspective view showing the assemblage of fibers used in Embodiment 4.

By using the various alumina-silica fibers shown in Table 1 ring-like assemblages of fibers having the shape as shown in FIG. 14 were prepared. Each such ring-like assemblage of fibers had an outer diameter of 95 mm, an inner diameter of 75 mm, and a height of 25 mm. Further, in each assemblage of fibers the fibers were bound by silica of 10–12 wt.% so that the assemblage of fibers showed a compression strength of 2.0–3.5 kg/cm$^2$.

Figure 15:
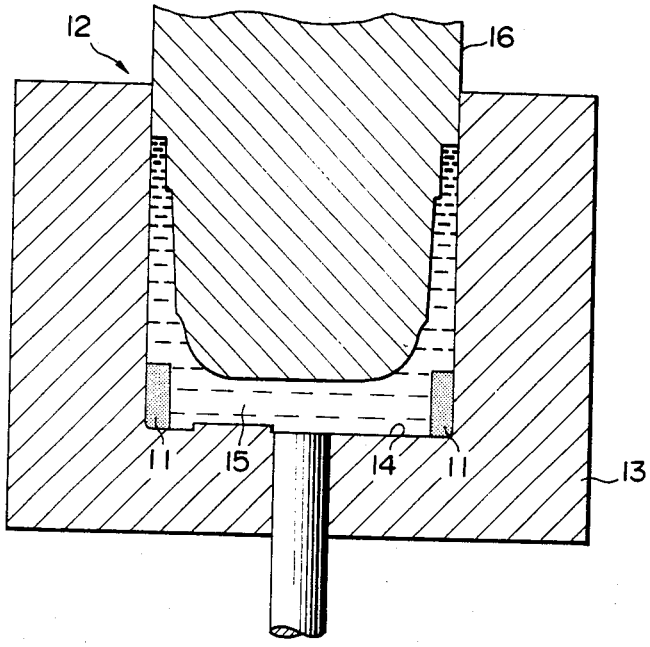
FIG. 15 is a schematic sectional view similar to FIG. 2 showing a casting process in the production of a piston in which a part thereof is reinforced by an assemblage of fibers.
Figure 16:
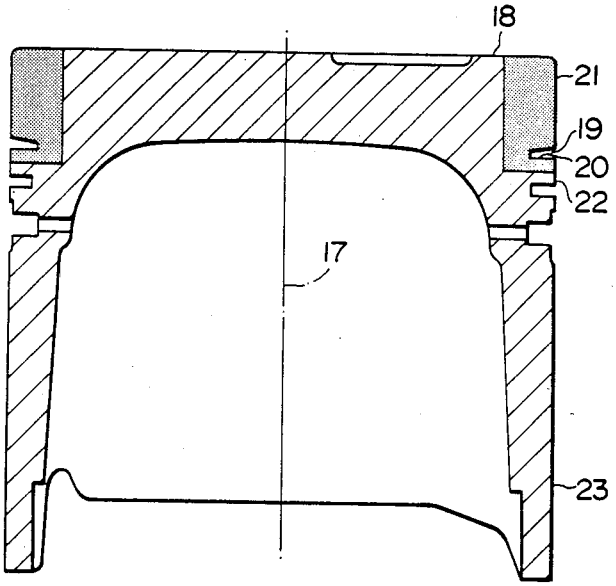
FIG. 16 is a schematic sectional view showing a piston in which a part thereof is reinforced by an assemblage of fibers.

Each assemblage of fibers 11 thus obtained was put into a mold 12 such as shown in FIG. 15 as placed on a bottom wall 14 of its lower mold 13 which defines a molding cavity, and a molten metal 15 of an aluminium alloy (JIS AC8A) was poured into the molding cavity to fill around the assemblage of fibers 11. Then an upper mold 16 was driven into the molding cavity so as to pressurize the molten metal 15 up to a pressure of 1000 kg/cm$^2$ thereby infiltrating the molten aluminium alloy around the fibers of the assemblage of fibers, and the pressurized condition was maintained until the aluminium alloy had completely solidified to provide a material block for a piston. Then the material block was treated by thermal treatment $T_7$ and was worked by machining such as cutting to finally provide a piston such as shown in FIG. 16. The piston had an annular reinforced portion including the assemblage of fibers 11 which finally had an outer diameter of 90 mm, a radial thickness of 7.5 mm and an axial length adjacent the piston head 18 of about 23 mm. A top ring groove 19 was formed into the reinforced portion so that the top land 21 and the second land 22 are separated thereby and the second land 22 includes an annular part of the fiber-reinforced portion which has an axial thickness of about 2 mm positioned below the bottom wall 20 of the top ring groove 19.

The pistons thus obtained were incorporated into the cylinders of a four cylinder four stroke cycle diesel engine having particulars such as a compression ratio of 21.5 and a displacement of 2198 cc, the cylinder liners of which are made of spherulitic graphite cast iron (JIS FCD70) in order to check the compatibility between a piston including such a fiber-reinforced portion and a cylinder liner made of spherulitic graphite case iron. Test conditions are shown in Table 4.

TABLE 4

| | |
|---|---|
| Fuel | light oil |
| Engine revolution | 4800 RPM (20% overrun) |
| Engine load | full load |
| Cooling water temp. | 120° C. |
| Test duration | 1 hour |

Figure 17:
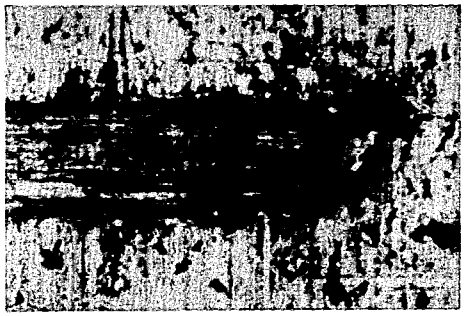
FIG. 17 is a microscopic photograph showing a longitudinal scar generated in the skirt portion of the piston shown in FIG. 16 in a test operation thereof by 100 magnification.
Figure 18:
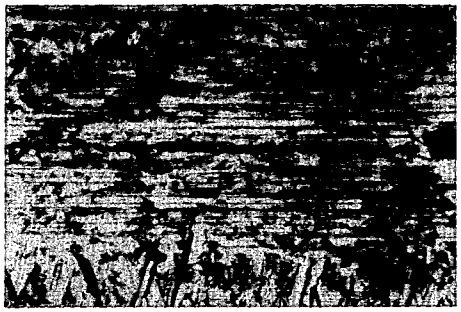
FIG. 18 is a microscopic photograph showing scuffings generated in the cylinder liner in a test operation of the piston shown in FIG. 16 by 200 magnification.

As the results of testing operations, it was found that in the piston which included the part reinforced by fibers $A_1$ a number of longitudinal scars which extend along the central axis 17 of the piston were generated in the skirt portion 23 of the piston, as shown in FIG. 17. These scars were observed as incorporating a lot of particles having the same chemical composition as the non-fibered particles of fibers $A_1$ embedded in the portions of the longitudinal scars. It was also observed that in the case of the piston having the part reinforced by fibers $B_1$ scuffings such as shown in FIG. 18 were generated on the surface of the cylinder liner in the area where the piston heat 18 is located when the piston is in its top dead center.

The states of generation of the longitudinal scars in the skirt portion 23 of the piston and the scuffings in the cylinder liners are shown in Table 5 with respect to the pistons partly reinforced by the above-mentioned reinforcing fibers.

TABLE 5

| Fibers | Long. scars | Scuffings |
|---|---|---|
| $A_1$ | many | slight |
| $A_2$ | slight | no |
| $A_3$ | no | no |
| $A_4$ | no | no |
| $A_5$ | no | no |
| $B_1$ | slight | large and deep |
| $B_2$ | no | no |
| C | no | no |

It will be understood from Table 5 that when the pistons are partly reinforced by the assemblies of fibers as described above, the amount of non-fibered particles, particularly the amount of the non-fibered particles having diameters not less than 150 microns, must be controlled to be low in order to avoid the problems that the longitudinal scars are generated in the skirt portion of the piston and that the scuffings are generated in the cylinder liner which operates as the mating member of the piston.

A set of pistons of the same partially fiber-reinforced structure as those used in the above described scuffing tests were prepared with respect to fibers $A_1$, $A_2$, $A_3$, $A_5$, $B_2$ and C shown in Table 1 in order to check antiwearing characteristic and anti-collapsing characteristic of the upper and the lower wall faces of the top ring groove of the piston. These pistons were equipped with piston rings made of a spherulitic graphite cast iron (JIS FCD70) in their top ring grooves and were assembled into the same four cylinder four stroke cycle diesel engine as used in the above-mentioned scuffing tests. The tests were performed under search operational conditions of the engine as shown in Table 6. For the purpose of comparison a piston made of only the same aluminum alloy (JIS AC8A) and treated by heat treatment $T_6$ and a piston having a ring of niresist cast iron as cast in its annular portion which provides the top ring groove were prepared and tested in the same manner.

TABLE 6

| | |
|---|---|
| Fuel | light oil |
| Engine revolution | 4400 RPM |
| Engine load | full load |
| Cooling water temp. | 90–100° C. |
| Test duration | 300 hours |

After the test operations, the top ring grooves of the pistons were examined by observation. In the pistons partly reinforced by fibers $A_5$, $B_2$ and C the conditions of the upper and the lower wall face of the top ring groove were much better than those of the piston made of only the aluminum alloy in the view point of anti-wearing characteristics as well as anti-collapsing characteristic. It was also observed that the piston reinforced by fibers $A_2$ was substantially the same as the piston reinforced by fibers $A_5$ with respect to their anti-wearing characteristic and anti-collapsing characteristic, though several light scars were observed in the skirt portion of the piston reinforced by fibers $A_2$.

Figure 19:
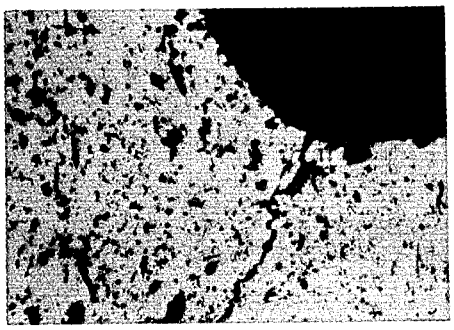
FIG. 19 is a microscopic photograph showing a crack generated through the bottom of the top ring groove of the piston by 100 magnification.
Figure 20:
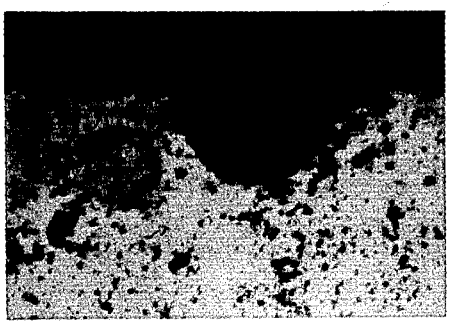
FIG. 20 is a microscopic photograph showing a scar generated in the lower wall face of the top ring groove by the dropping off of a non-fibered particle.

However, in the piston partly reinforced by fibers $A_1$ a large number of longitudinal scars were observed as generated in its skirt portion, and further a crack was found at a bottom portion of the top ring groove as shown in FIG. 19, and still further a scar caused by the dropping of a non-fibered particle was found in the lower wall face of the top ring groove as shown in FIG. 20.

In the piston which had the cast-in niresist cast iron ring a heat seizure between the top land and the cylinder liner occurred when 68 hours had lapsed from the start of the test operation. Since the thermal conductivity of niresist cast iron is much lower than that of the aluminum alloy herein used, it is guessed that the top land portion of the piston having the cast in niresist ring had reached a very high temperature. The temperatures which the wall faces of the top ring grooves of the other fiber-reinforced pistons reached were guessed by measuring the hardness of the areas around the top ring grooves, and were guessed to be 200°–250° C. These low temperatures show that the fiber-reinforced parts as described above have much better heat dissipation performance than the cast-in niresist ring.

From the test results of this Embodiment 4 it will be appreciated that by incorporating the composite material according to the present invention in the top land portion and the top ring groove portion of a piston the performance of the piston can be much improved so that the top land portion has high anti-seizure characteristic and the wall portions around the top ring groove have high anti-wearing and anti-collapsing characteristics, while the amount of wear caused in the piston ring is suppressed to the minimum value.

Although the present invention has been described with respect to several preferred embodiments thereof, it should not be considered that the present invention is limited to these embodiments, because various modifications of the embodiments herein shown would be conceived of by one of ordinary skill in the art without departing from the scope of the present invention.

We claim:

1. A composite material comprising a matrix of a metal selected from a group consisting of aluminum, magnesium and their alloys, and reinforcing members of an assemblage of alumina-silica fibers containing not less than 40 wt.% alumina, said assemblage of alumina-silica fibers having a virtual density of 0.08–0.3 g/cm$^3$ and including present in an amount of not more than 17 wt.%, nonfibered particles of the same material as the fibers whereas not more than 7 wt.% nonfibered particles are not smaller than 150 microns diameter.

2. A composite material according to claim 1, wherein the amount of non-fibered particles included in assemblage of alumina-silica fibers is not more than 10 wt.%.

3. A composite material according to claim 1 or 2, wherein the amount of non-fibered particles of not smaller than 150 microns diameter is not more than 2 wt.%.

4. A composite material according to claim 1, wherein the virtual density of the assemblage of alumina-silica fibers is 0.08–0.25 g/cm$^3$.

* * * * *